US010215369B2

(12) United States Patent
Fujisawa et al.

(10) Patent No.: US 10,215,369 B2
(45) Date of Patent: Feb. 26, 2019

(54) LIGHTING APPARATUS

(71) Applicant: MINEBEA MITSUMI, INC., Kitasaku-gun, Nagano (JP)

(72) Inventors: Shinichi Fujisawa, Kitasaku-gun (JP); Takuya Nagai, Kitasaku-gun (JP)

(73) Assignee: MINEBEA MITSUMI INC., Nagano (JP)

( * ) Notice: Subject to any disclaimer, the term of this patent is extended or adjusted under 35 U.S.C. 154(b) by 126 days.

(21) Appl. No.: 15/361,796

(22) Filed: Nov. 28, 2016

(65) Prior Publication Data

US 2017/0074488 A1 Mar. 16, 2017

Related U.S. Application Data

(63) Continuation of application No. PCT/JP2015/061459, filed on Apr. 14, 2015.

(30) Foreign Application Priority Data

May 29, 2014 (JP) ..... 2014-111076

(51) Int. Cl.

| | |
|---|---|
| ***F21V 14/02*** | (2006.01) |
| ***F21S 8/04*** | (2006.01) |
| ***F21V 5/04*** | (2006.01) |
| ***F21V 17/00*** | (2006.01) |

(Continued)

(52) U.S. Cl.

CPC ..... *F21V 14/02* (2013.01); *F21S 8/04* (2013.01); *F21S 8/043* (2013.01); *F21V 5/04* (2013.01);

(Continued)

(58) Field of Classification Search

CPC ..... F21V 14/02; F21V 14/04; F21V 29/503; F21V 29/763; F21V 29/04; F21V 5/04;

(Continued)

(56) References Cited

U.S. PATENT DOCUMENTS 6,174,071 B1 1/2001 Chan
7,513,660 B2 * 4/2009 Spartano ..... F21L 14/00 362/105

(Continued)

FOREIGN PATENT DOCUMENTS

CN 1570689 A 1/2005
CN 202082737 U 12/2011

(Continued)

OTHER PUBLICATIONS

Jun. 23, 2015 International Search Report issued in International Patent Application No. PCT/JP2015/061459.

(Continued)

*Primary Examiner* — Anabel Ton
(74) *Attorney, Agent, or Firm* — Pearne & Gordon LLP

(57) ABSTRACT

A lighting apparatus includes a light source unit having a light source portion configured to mount a light source thereon, and a light distribution angle adjusting means coupled to the light source portion and configured to change an irradiation range of the light source. The light distribution angle adjusting means includes a reflector provided with a spiral guide portion in a peripheral surface thereof and configured to reflect a light emitted from the light source, a movable body having an engaging portion configured to slidably engage the guide portion and a control portion configured to limit a direction of a movement to a rotation axis direction of the reflector, a support configured to support a movement of the movable body in the rotation axis direction of the reflector, and an optical component secured to the movable body and configured to change a light path of the light.

8 Claims, 13 Drawing Sheets

(51) Int. Cl.

| | |
|---|---|
| ***F21V 21/15*** | (2006.01) |
| ***F21V 21/26*** | (2006.01) |
| ***F21V 21/30*** | (2006.01) |
| ***F21V 23/04*** | (2006.01) |
| ***F21V 29/503*** | (2015.01) |
| ***F21V 29/76*** | (2015.01) |
| ***F21V 7/04*** | (2006.01) |
| ***F21V 13/04*** | (2006.01) |
| ***F21V 14/04*** | (2006.01) |

(52) U.S. Cl.
CPC ..... *F21V 5/045* (2013.01); *F21V 7/041* (2013.01); *F21V 13/04* (2013.01); *F21V 14/04* (2013.01); *F21V 17/00* (2013.01); *F21V 21/15* (2013.01); *F21V 21/26* (2013.01); *F21V 21/30* (2013.01); *F21V 23/04* (2013.01); *F21V 29/503* (2015.01); *F21V 29/763* (2015.01)

(58) Field of Classification Search
CPC ..... F21V 5/045; F21V 7/041; F21V 13/04; F21V 17/00; F21V 21/15; F21V 21/26; F21V 21/30; F21S 8/04; F21S 8/043
See application file for complete search history.

(56) References Cited

U.S. PATENT DOCUMENTS

| | | | | |
|---|---|---|---|---|
| 9,004,720 | B2 | 4/2015 | Melzner et al. | |
| 9,470,871 | B2 * | 10/2016 | Tohjima ..... | G02B 7/04 |
| 2005/0078482 | A1 | 4/2005 | Bartlett | |
| 2009/0290351 | A1 * | 11/2009 | Chan ..... | F21V 14/04 362/277 |
| 2013/0301254 | A1 | 11/2013 | Popper et al. | |
| 2013/0322084 | A1 | 12/2013 | Ebisawa | |

FOREIGN PATENT DOCUMENTS

| | | | |
|---|---|---|---|
| EP | 0 774 616 | A2 | 5/1997 |
| JP | 61-184296 | A | 8/1986 |
| JP | 02-029395 | U1 | 2/1990 |
| JP | H06-338210 | A | 12/1994 |
| JP | 2001-289394 | A | 10/2001 |
| JP | 2007-005216 | A | 1/2007 |
| JP | 2009-508297 | A | 2/2009 |
| JP | 2011-192548 | A | 9/2011 |
| JP | 2013-247086 | A | 12/2013 |

OTHER PUBLICATIONS

Extended European Search Report dated Dec. 14, 2017 for corresponding European Application No. 15799986.2.
Chinese Office Action dated May 25, 2018 for corresponding Chinese Application No. 2015800276620.
Japanese Office Action for corresponding Japanese Application No. 2017-143249 dated Jul. 3, 2018.

* cited by examiner

LIGHTING APPARATUS

TECHNICAL FIELD

The present invention relates to a lighting apparatus.

BACKGROUND ART

A lighting apparatus disclosed in, for example, Patent Document 1 is provided with a mechanism for horizontal rotation, a mechanism for vertical rotation, and a mechanism for changing a shape of a concave mirror that reflects light emitted from a light source. Each of the mechanisms is controlled by a motor (i.e., a horizontal rotation motor, a vertical rotation motor, and a concave mirror control motor).

In addition, the lighting apparatus disclosed in Patent Document 1 uses a remote controller to transmit a control command to each of the motors to allow the horizontal rotation, the vertical rotation, and the light distribution state of the lighting apparatus to be remotely controlled.

CITATION LIST

Patent Literature

Patent Document 1: Japanese Publication No. 06-338210 (A)

SUMMARY OF INVENTION

Technical Problem

The light distribution control of the lighting apparatus disclosed in Patent Document 1 is performed by changing the shape of the concave mirror. Changing the shape of the concave mirror can be performed by forming the concave mirror by plurality of mirror pieces and controlling the state of the mirror pieces. For the above reason, the plurality of mirror pieces are used for the construction of the concave mirror and various parts is used for a mechanism for controlling the state of the mirror pieces. Increase in the number of the parts used not only increases cost for the parts, but also renders assembling work complicated, thereby generally increasing manufacturing cost.

Furthermore, the lighting apparatus disclosed in Patent Document 1 supports a lamp body (i.e., a lighting body) at another end of a pair of arms such that the lamp body is rotatable in a vertical direction, and performs a vertical rotation control of the lamp body (i.e., the lighting body) by transmitting the torque of a vertical rotation motor disposed at one end of the pair of arms to the lamp body (i.e., the lighting body) rotatably supported at another end of the pair of arms via a mechanism such as a belt disposed inside the arm. For this reason, a plurality of parts such as a gear, a geared belt, and a tension pulley for setting a tension between the gear and the geared belt is received in the arm. In order to accommodate such parts in the arm, the outer shape of the arm becomes bigger, thereby increasing the thickness of the arm. Accordingly, it is hard to attain a slim arm shape which is preferable in terms of design properties. As such, in accordance with the lighting apparatus disclosed in Patent Document 1, the mechanism for vertical rotation also needs increased number of parts, thereby increasing manufacturing cost and failing to attain slim arm shape that is preferable in terms of design properties.

Furthermore, in accordance with the lighting apparatus disclosed in Patent Document 1, the mechanism for horizontal rotation uses a plurality of parts such as a gear, a geared belt, and a tension pulley for setting a tension between the gear and the geared belt to transmit the torque of the horizontal rotation motor to the arm which is rotatably supported in a horizontal direction, thereby increasing manufacturing cost associated with the mechanism for horizontal rotation and having a difficulty in attaining compactness and good looking.

As described above, the lighting apparatus described in Patent Document 1 needs increased number of parts, burdensome assembling, thereby increasing manufacturing cost and failing to attain compact and slim design. Accordingly, there is a room for improving the appearance of the lighting apparatus.

The invention has been made in view of the circumstances as described above, and provides a simplified lighting apparatus with decreased number of parts, allowing for reducing manufacturing cost. Moreover, the invention provides a compact and slim lighting apparatus in terms of design properties.

Solution to Problem

In order to the afore-mentioned objective, the invention provides:

(1) A lighting apparatus includes a light source unit, which includes a light source portion configured to mount a light source thereon, and a light distribution angle adjusting means coupled to the light source portion and configured to change an irradiation range of the light source. The light distribution angle adjusting means includes a reflector provided with a spiral guide portion in a peripheral surface thereof and configured to reflect a light emitted from the light source; a movable body including an engaging portion configured to slidably engage the guide portion and a control portion configured to limit a direction of a movement of the movable body to a rotation axis direction of the reflector; a support configured to support a movement of the movable body in the rotation axis direction of the reflector, and an optical component secured to the movable body and configured to change a light path of the light emitted from the light source.

(2) In above (1), the control portion may be a convex portion formed on an outer periphery of the movable body; the support may include a groove portion which is formed on an inner peripheral surface of the support in the rotation axis direction; and the convex portion may slidably engage the groove portion to allow the movable body to be supported by the support.

(3) In above (1) or (2), the lighting apparatus may further include a horizontal angle adjusting means configured to rotate the light source unit in a horizontal direction and a vertical angle adjusting means configured to rotate the light source unit in a vertical direction.

(4) In above (3), the lighting apparatus may further include a lighting body having a housing coupled to the light source unit; an U-shaped arm having a pair of arm portions and configured to rotatably support the lighting body; and a base portion configured to support a horizontal rotary member to which the arm is secured such that the horizontal rotary member is rotatable in a horizontal direction. The horizontal angle adjusting means may include the horizontal rotary member, and a diving source A and gear train A disposed in the base portion and configured to rotate the horizontal rotary member. The vertical angle adjusting means may include a driving source B and gear train B mounted in the housing to be arranged at an end of one of the pair of arm portions and configured to rotate the lighting body with respect to the arm portion. The light distribution angle adjusting means may include a driving source C and gear train mounted in the housing to be arranged at an end of another of the pair of arm portions and configured to rotate the reflector (5) In above (4), the gear train B may include an epicycle gear.

(6) In any of above (3) to (5), the lighting apparatus may further include a wireless communication unit configured to perform a communication with any of the light distribution angle adjusting means, the horizontal angle adjusting means and the vertical angle adjusting means.

Advantageous Effects of Invention

The invention provides a simplified lighting apparatus with reduced number of parts or components, and reduced manufacturing cost. Also, the invention can provide a lighting apparatus with a slim and compact design.

DESCRIPTION OF EMBODIMENT

Figure 1:
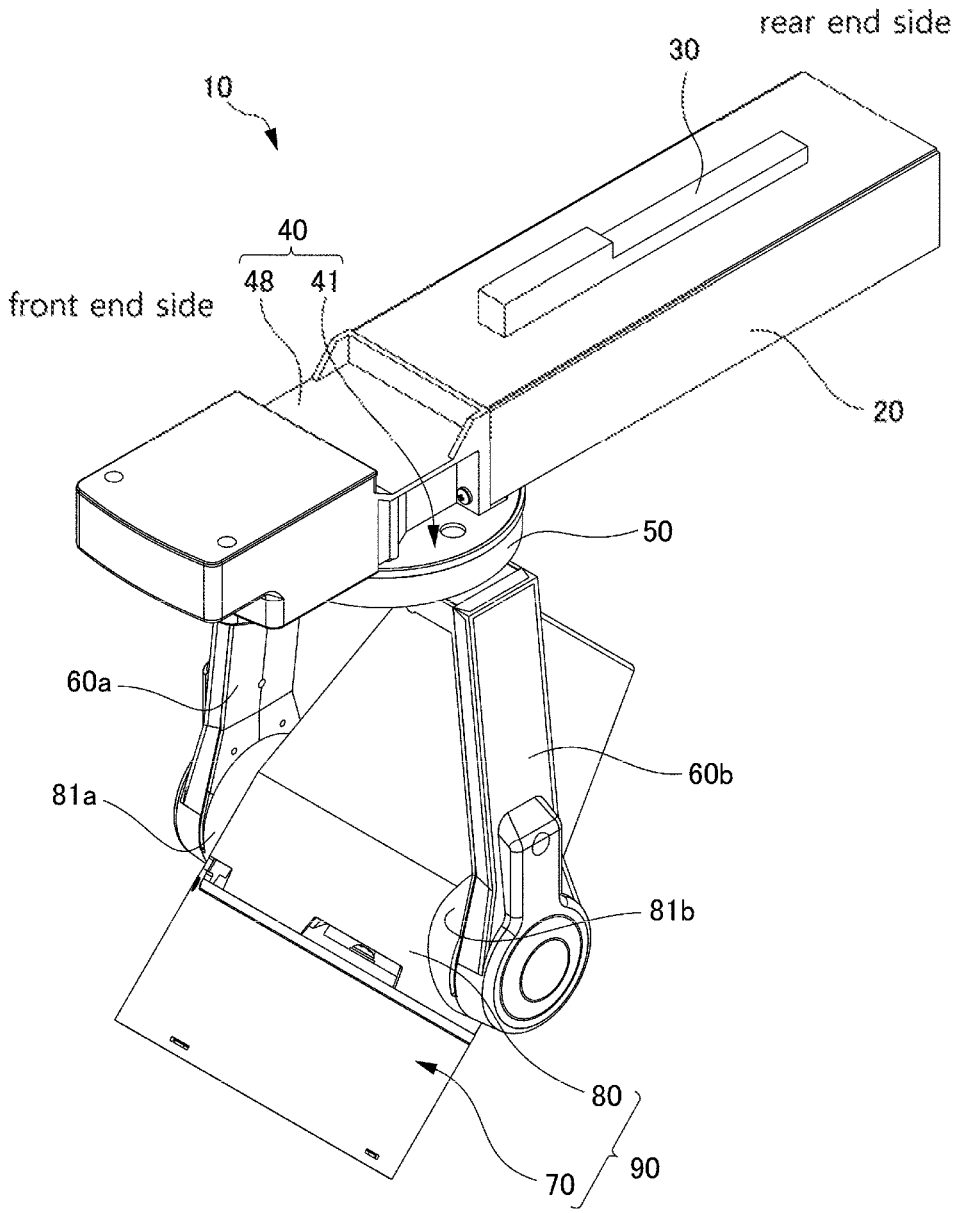
FIG. 1 is a perspective view of a spot-lighting apparatus according to an embodiment of the invention.

With reference to the accompanying drawings, embodiments of the present invention (hereinafter, referred to as "embodiments") will be hereinafter described. Throughout the description of the embodiments, the same reference numeral is assigned to the same element. In the following description of the embodiment, a spot-lighting apparatus which is attached to a ceiling surface will be described as an example. Throughout the specification, the terms "horizontal", "vertical", "anteroposterior" and "left and right" are used in a case where the lighting apparatus is attached to a flat and planar ceiling surface. Accordingly, in a case where a spot-lighting apparatus is attached to a vertical wall surface, a vertical relationship and a horizontal relationship are reversed, and the term "vertical" used in the specification should be interpreted to mean "horizontal". Furthermore, a front side indicates a side (i.e., direction) from which light of a light source is emitted, and a rear side indicates a side (i.e., direction) opposite to the front side.

(Overall Construction of a Lighting Apparatus)

FIG. 1 is a perspective view of a spot-lighting apparatus according to an embodiment of the invention. As shown in FIG. 1, the spot-lighting apparatus 10 has a coupling portion 30 disposed on a power supply member 20 (e.g., a power adapter) and configured to couple the spot-lighting apparatus 10 to a ceiling surface and etc., and a base portion 40 which supports a horizontal rotary member 50 relative to a leading end side (i.e., a left side in FIG. 1) of the power supply member 20 such that the horizontal rotary member 50 is rotatable in a horizontal direction.

Furthermore, a base end side of a U-shaped arm having a pair of arm portions 60*a*, 60*b* is secured to a lower surface of the horizontal rotary member 50. The pair of arm portions 60*a*, 60*b* rotatably supports a housing 80 in a vertical direction, and the housing 80 is provided at a leading end thereof with a light source unit 70.

Figure 2:
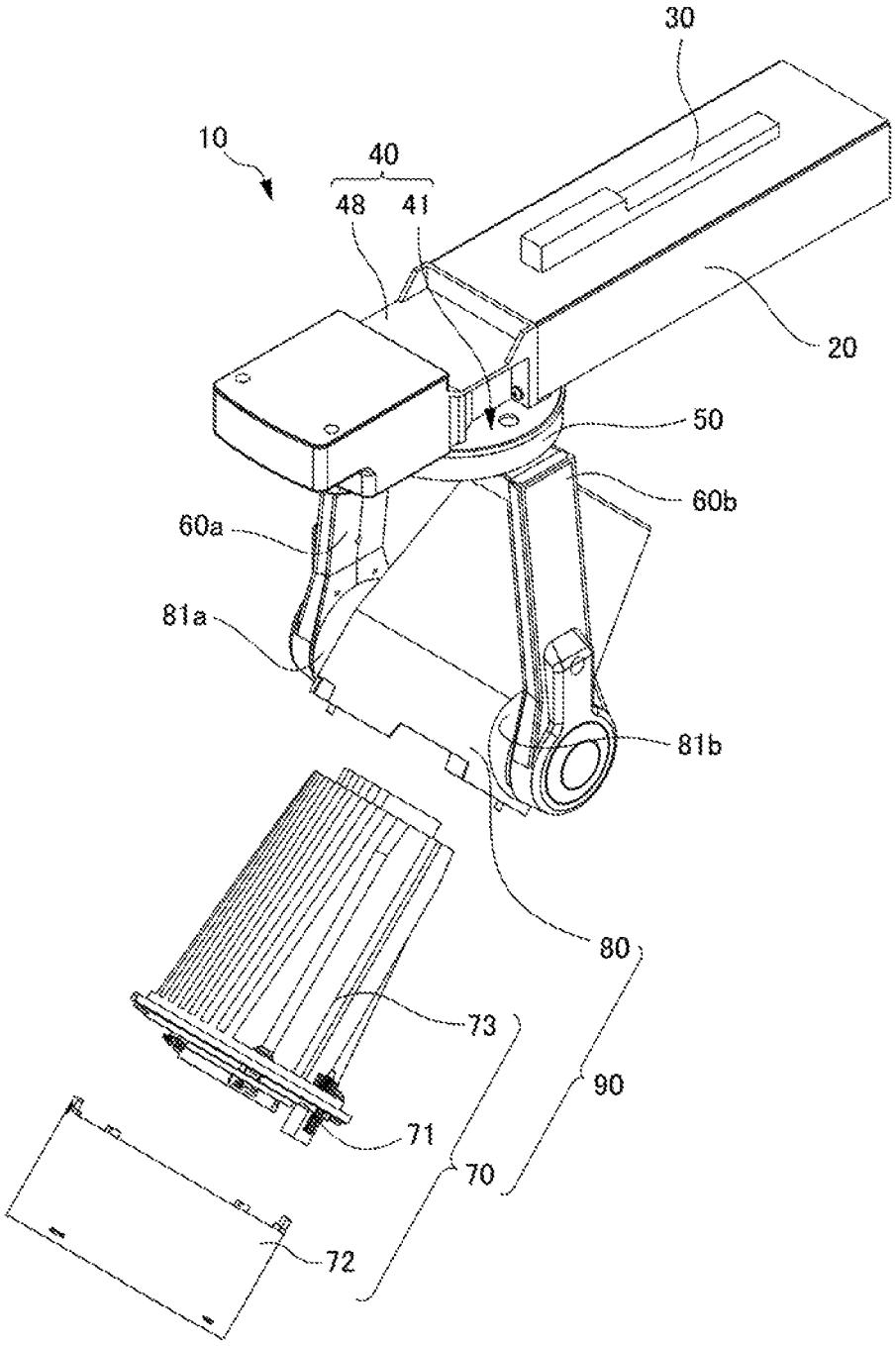
FIG. 2 is an exploded perspective view where a light source unit is detached from a housing of FIG. 1.

FIG. 2 is an exploded perspective view where the light source unit 70 is detached from the housing 80 of the spot-lighting apparatus 10 of FIG. 1. As shown in FIG. 2, the light source unit 70 has a light source portion 71 provided with a light source and a mounting member for mounting the light source, a heat sink member 73 coupled to a rear side of the light source unit 71, and a light distribution angle adjusting mechanism 72 coupled to a front side of the light source portion 71 for constructing light distribution angle adjusting means.

In the embodiment, an LED is used as the light source, and an LED board is provided at a substantially central portion of the light source portion 71. The LED generates heat during light emission, and the elevated temperature of the LED renders light emission efficiency and lifetime reduced. For the above reason, it is preferable to radiate heat during light emission. Therefore, in the embodiment, the heat sink member 73 is coupled to the rear side of the light source portion 71 thereby enhancing heat dissipation.

Furthermore, the mounting member for mounting the light source thereon is preferably formed of a material that can efficiently transfer heat from the light source to the heat sink member 73, for example, metal such as aluminum.

In addition, if there is a gap between the light source and the mounting member and/or between the mounting member and the heat sink member, the efficiency of heat transfer from the heat source to the heat sink member 73 is reduced. For the above reason, it is preferable that in order not to create a gap between the light source and the mounting member, as well as, between the mounting member and the heat sink member a heat dissipation sheet and the like is interposed therebetween.

While in the embodiment, the heat sink member 73 is adopted for high-power LED, such a heat sink member may not be necessary in the case of low-power LED. In such a case, the heat sink member 73 may be omitted. In this case, due to the absence of the heat sink member 73, the weight of the light source unit 70 can be reduced. Furthermore, the type of the light source is not limited to LED and a bulb-type light source may be used.

With reference to FIGS. 1 and 2, a brief operation of the spot-lighting apparatus 10 will be described in advance. The structure of the spot-lighting apparatus 10 will be described in more detail after the description of the operation. As shown in FIG. 2, the spot-lighting apparatus 10 can adjust a spreading angle of the emitted light by means of the light distribution angle adjusting mechanism 72 which is disposed at the front side of the light source unit 70. The light source unit 70 is coupled to the housing 80 such that the heat sink member 73 which is disposed at the rear side of the light source unit 70 is received in the housing 80. The housing 80 is provided with a pair of cylindrical portions 81*a*, 81*b* which is respectively disposed at locations corresponding to ends of the pair of arm portions 60*a*, 60*b*.

The cylindrical portions 81*a*, 81*b* are respectively rotatable relative to the ends of the arm portion 60*a*, 60*b*.

Accordingly, a lighting body 90 where the light source unit 70 is coupled to the housing 80 is rotatable with respect to the arm portions 60*a*, 60*b*, and the orientation of the lighting body 90 including the light source unit 70 can be changed in a vertical direction. As will be described later in detail, vertical angle adjusting means for adjusting a vertical angle is mounted in the cylindrical portion 81*a* of the housing 80 which is disposed at the end of the arm portion 60*a*.

The base end side of the U-shaped arm which is opposite to the end of the pair of arm portions 60*a*, 60*b* is secured to the horizontal rotary member 50, and due to the rotation of the horizontal rotary member 50 the lighting body 90 including the light source unit 70 is adapted to rotate in a horizontal direction. As will be described later in detail, the horizontal rotary member 50 is rotated in the horizontal direction by a rotary motor and a gear train which are mounted in the base portion 40 which is disposed at a leading end side (left side in the figure) of the power supply member 20.

As described above, the spot-lighting apparatus 10 performs the control of the light distribution angle, the control of the vertical angle (i.e., tilting), and the control of the horizontal angle (i.e., panning). Next, a mechanism for performing the control of the light distribution angle, the control of the vertical angle (i.e., tilting) and the control of the horizontal angle (i.e., panning) will be sequentially described in detail.

(Light Distribution Angle Adjusting Means)

Figure 3:
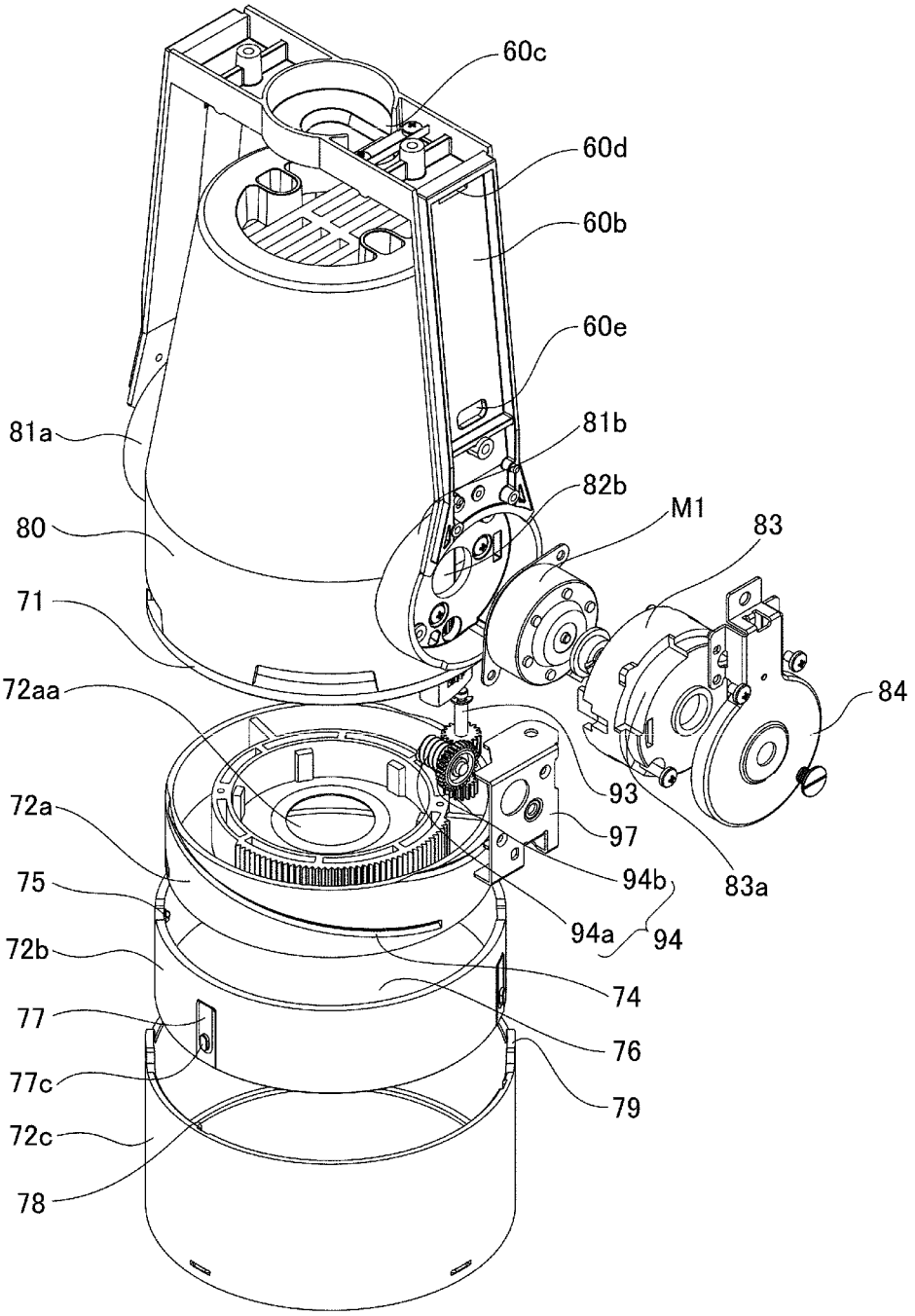
FIG. 3 is an exploded perspective view showing a construction of light distribution angle adjusting means.

FIG. 3 is an exploded perspective view to assist in understanding the construction of the light distribution angle adjusting means. As shown in FIG. 3, the light distribution angle adjusting mechanism 72 of the light distribution angle adjusting means is mainly comprised of a reflector 72*a*, a movable body 72*b* which is disposed so as to surround the outer periphery of the reflector 72*a*, and a support 72*c* which is disposed to surround the outer periphery of the movable body 72*b* to support the movable body 72*b*.

Figure 4:
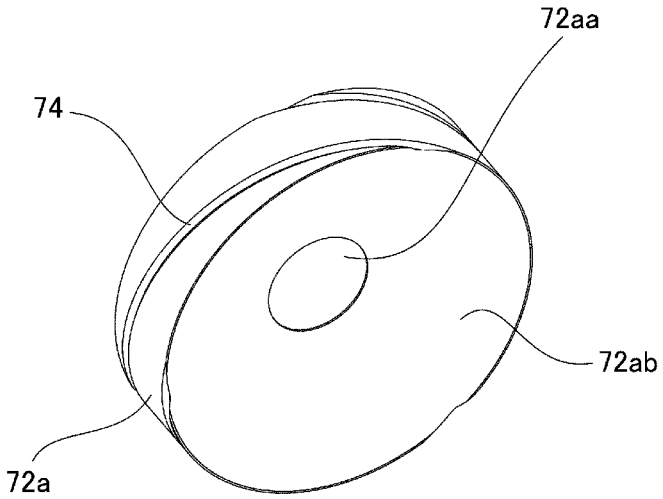
FIG. 4 is a perspective view of a reflector.

The reflector 72*a* is provided with a circular opening 72*aa* in a location corresponding to the light source (LED) mounted on the light source portion 71. In other words, the circular opening 72*aa* is disposed in the central portion of the reflector 72*a*. FIG. 4 is a view of the reflector 72*a* viewed from the front side. As shown in FIG. 4, the front side of the reflector 72*a* is conically recessed toward the central circular opening 72*aa* to form a reflecting surface 72*ab* for reflecting the light emitted from the light source forward. Since the reflecting surface 72*ab* is intended to reflect light, it preferably has a white or silver color with high level of light reflectance.

Returning to FIG. 3, focusing on the outer peripheral surface (i.e., circumferential surface) of the reflector 72*a*, the outer peripheral surface of the reflector 72*a* is provided with a spiral guide groove 74 (i.e., guide portion). On the other hand, the inner peripheral surface of the rear end portion of the movable body 72*b* (i.e., the end portion of the movable body 72*b* adjacent to the reflector 72*a*) is provided with an engaging projection 75 (i.e., an engaging portion) which slidably engages the helical guide groove 74 of the reflector 72*a*. The engaging projection 75 engages the guide groove 74 of the reflector 72*a*, thereby allowing the movable body 72*b* to surround the outer peripheral surface of the reflector 72*a*. Furthermore, in a case where the reflector 72*a* is provided as a molded resin article, the guide groove 74 formed in the outer peripheral surface of the reflector 72 allows for an inexpensive mold.

Figure 5A:
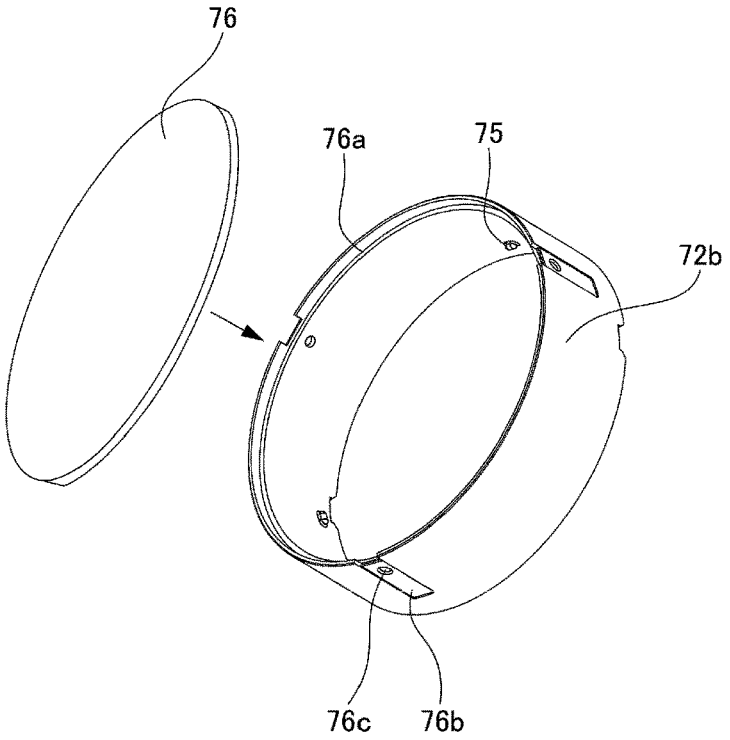
FIG. 5A is a partial exploded perspective view of a mobile body to which an optical component is mounted.

Furthermore, the moving body 72*b* is provided at the front side thereof with a Fresnel lens 76 as an optical component for the control of the light distribution. FIG. 5A is a perspective view of the movable body 72*b* viewed from the front side. As shown in FIG. 5A, the movable body 72*b* is a cylindrical member, and has a step 76*a* for receiving the Fresnel lens 76 in the front inner peripheral edge. After the Fresnel lens 76 is disposed in the step 76*a*, a lens-securing pin 77 is coupled to the front peripheral edge of the movable body 72*b* to secure the Fresnel lens 76 to the movable body 72*b*, as shown in FIG. 3.

Figure 5B:
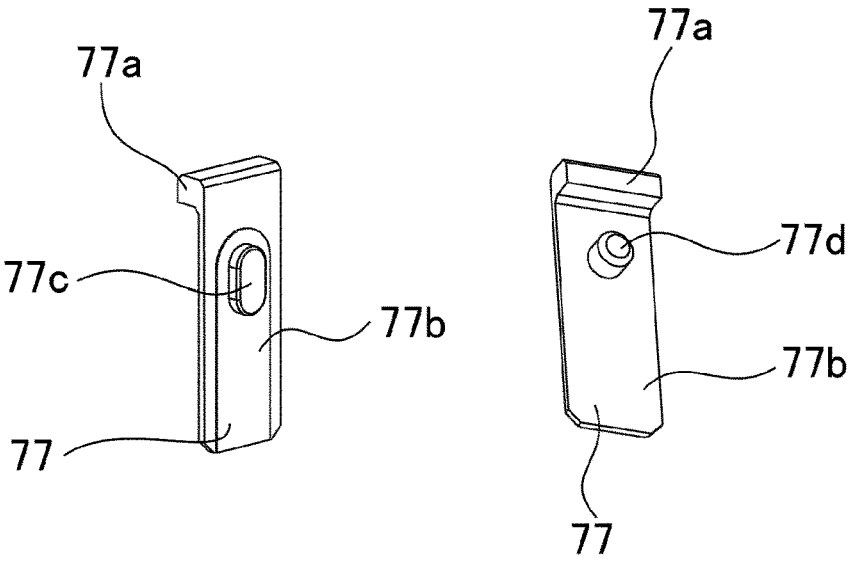
FIG. 5B is a partial exploded perspective view of the mobile body showing a part for securing the optical component to the mobile body.

FIG. 5B is an enlarged view of a lens-securing pin 77. The left figure of FIG. 5B is a perspective view of the lens-securing pin 77 to assist in understanding of the exterior surface side of the lens-securing pin 77 which is exposed when the lens-securing pin 77 is coupled to the movable body 72*b*, and the right figure of FIG. 5B is a perspective view of the lens-securing pin 77 to assist in understanding the interior surface side of the lens-securing pin 77 facing the movable body 72*b* side.

The lens-securing pin 77 is in contact with the front peripheral edge of the movable body 72*b*, and is an approximately L-shaped member which has a holding portion 77*a* configured to prevent the Fresnel lens 76 from falling from the movable body 72*b*, and an abutting portion 77*b* which is disposed in contact with the outer peripheral surface of the movable body 72*b*. As shown in the left figure, the exterior surface of the abutting portion 77*b* is provided with a convex portion 77*c*.

As shown in the right figure, the interior surface of the abutting portion 77*b* of the lens-securing pin 77 is provided with an engaging boss 77*d*. As shown in FIG. 5A, the portion of the movable body 72*b* to which the lens-securing pin 77 is secured is provided with an approximately L-shaped recessed groove 76*b* for receiving the lens-securing pin 77 therein. The recessed groove 76*b* is provided with an engaging hole 76*c* for receiving the engaging boss 77*d* of the lens-securing pin 77 therein. The engaging boss 77*d* is press-fit into the engaging hole 76*c* thereby securing the lens-securing pin 77 to the movable body 72*b*. Usually, the cylindrical part ensures smooth movement by increasing the accuracy of press-fit of the entire circumference. However, in this embodiment, as the abutting portion 77*b* of the lens-securing pin 77 and the inner peripheral surface of the support 72*c* are in a slidable relation, the movable body 72*b* and the support 72*c* do not need high level of dimensional accuracy of entire circumference, thereby rending manufacturing cost for the movable body 72*b* and the support 72*c* inexpensive.

Figure 6:
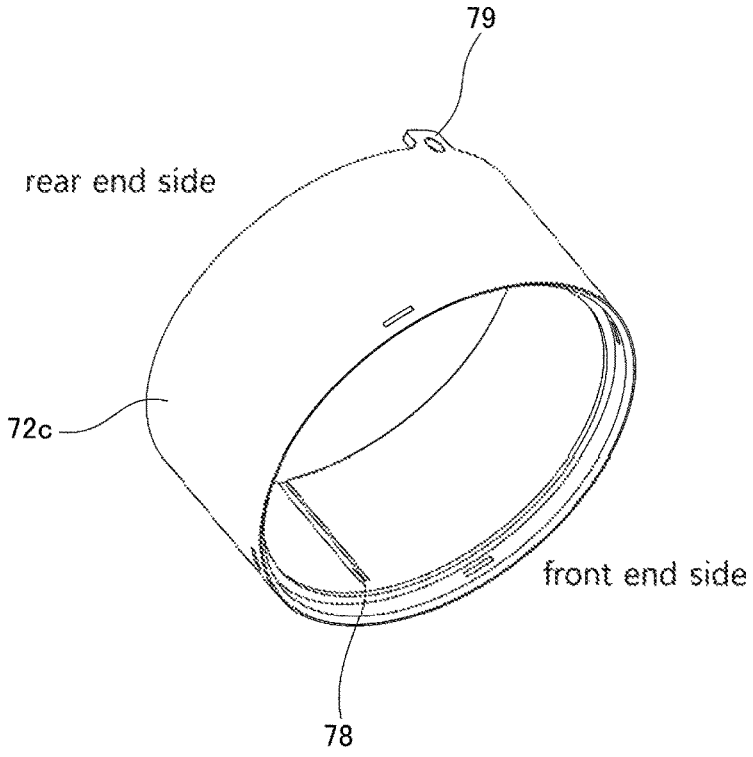
FIG. 6 is a perspective view of a support.

On the other hand, as shown in FIG. 6 corresponding to a perspective view of the support 72*c* viewed from the front side, the support 72 is also a cylindrical member, and the inner peripheral surface thereof is provided with a linear groove portion 78 which corresponds to the convex portion 77*c* of the lens-securing pin 77 as shown in FIG. 5B. The linear groove portion 78 extends in an anteroposterior direction. The linear groove portion 78 is opened at the rear end thereof and is not opened at the front end thereof. In this regard, a side of the rear end corresponds to a side of light source, and a side of the front end corresponds to a direction where light is emitted. That is, the linear groove portion 78 is formed from the rear end of the support 72*c* to an area near the front end of the support 72*c*, but does not reach the front end of the support 72*c*.

The movable body 72*b* which has been described with reference to FIG. 5 is coupled to the support 72*c* such that the convex portion 77*c* of the lens-securing pin 77 slidably engages the groove portion 78 formed in the inner peripheral surface of the support 42*c* from the rear side of the support 72*c*. Since as described above, the groove portion 78 only extends to the area near the front end of the support 72 so as not to be opened at the front end of the support 72*c*, the movable body 72 can be prevented from falling off the front side of the support 72*c* when sliding onto the groove portion 78 of the support 72*c* in the anteroposterior direction. Furthermore, the rear end of the support 72*c* is provided with a fixture 79 which is configured to secure the support 72*c* to the light source portion 71.

Referring to FIG. 3, the movable body 72*b* is assembled such that the engaging projection 75 of the movable body 72*b* slidably engages the helical guide groove 74 which is formed in the outer peripheral surface of the reflector 72*a*. Furthermore, the movable body 72*b* is assembled such that the convex portion 77*c* of the lens-securing pin 77 slidably engages the groove portion 78 which is formed in the inner peripheral surface of the support 72*c*. As such, the movable body 72*b* is supported by the support 72*c*. The support 72*c* is assembled such that the fixture 79 of the support 72*c* is secured to the light source portion 71.

While it is not shown, in the embodiment the light source mounted on the light source portion has a conical reflecting portion around the light source. The size of the central circular opening 72*aa* of the reflector 72*a* is in conformity with the outer shape of the conical reflecting portion which is disposed around the light source. When the fixture 79 of the support 72*c* is secured to the light source portion 71, the conical reflecting portion is fit into the circular opening 72*aa* of the reflector 72*a*. Since the reflector 72*a* is only supported by the reflecting portion of the light source which is fit into the circular opening 72*aa* of the reflector 72*a*, it is rotatable with respect to the light source portion 71.

Since the reflector 72*a*, the movable body 72*b* and the support 72*c* are assembled as described previously, once the reflector 72*a* is rotated, due to the torque of the reflector 72*a* the movable body 72 also attempts to rotate. However, the movement of the movable body 72*b* is restrained in the anteroposterior direction due to the convex portion 77*c* of the lens-securing pin 77 of the movable body 72*b*. Therefore, when the reflector 72*a* rotates, the movable body 72*b* moves in a rotation axis direction of the reflector 72*a* (i.e., the anteroposterior direction) while the engaging projection 75 of the movable body 72*b* sliding on the guide groove 74 of the reflector 72*a*. That is, the convex portion 77*c* of the lens-securing pin 77 of the movable body 72*b* functions as a control portion for limiting the direction of the movement of the moving body 72*b* to the rotation axis direction of the reflector 72*a*. As a result, the movable body 72*b* can only move in the rotation axis direction of the reflector 72*a*.

When the movable body 72*b* moves in the rotation axis direction, the distance between the light source and the Fresnel lens 76 coupled to the movable body 72*b* is changed. As a result, the light-concentrating state of the Fresnel lens 76 is changed, and the light distribution angle is thus changed. In the embodiment, when the movable body 72*b* is disposed most adjacent to the light source side, the spreading angle of the light which is emitted through the Fresnel lens 76 is set to about 30°. The reflector 72*a* can be rotated up to about 90°, and due to such a 90° rotation of the reflector 72*a* the movable body 72*b* moves away from the light source by about 15 mm. In such a case where the movable body 72*b* is most away from the light source, the spreading angle of the light which is emitted through the Fresnel lens 76 is set to about 10°.

However, the extent (i.e., angle) of the reflector 72*a*'s rotation as well as the extent of the moving body's movement in the anteroposterior direction may be determined depending on the light distribution angle required and the spot diameter of the LED used.

In the embodiment, the Fresnel lens 76 is used. This is because the Fresnel lens is adapted to easily control the light-concentrating state (i.e., spot diameter) with respect to long distance, and due to light weight thereof load on a driving portion can be reduced and impact resistance can be enhanced. However, the optical component for the light distribution control is not necessarily limited to the Fresnel lens, and the Fresnel lens may be replaced with other optical component such as an aspherical lens.

Next, the element for operating the light distribution angle adjusting mechanism 72 of the light distribution angle adjusting means, more specifically, the element for rotating the reflector 72*a* is described. The component or parts assembled will be described later. Firstly, the construction for rotating the reflector 72*a* is described with reference to FIG. 7 which mainly shows the components or parts associated with the rotation of the reflector 72*a*.

Figure 7:
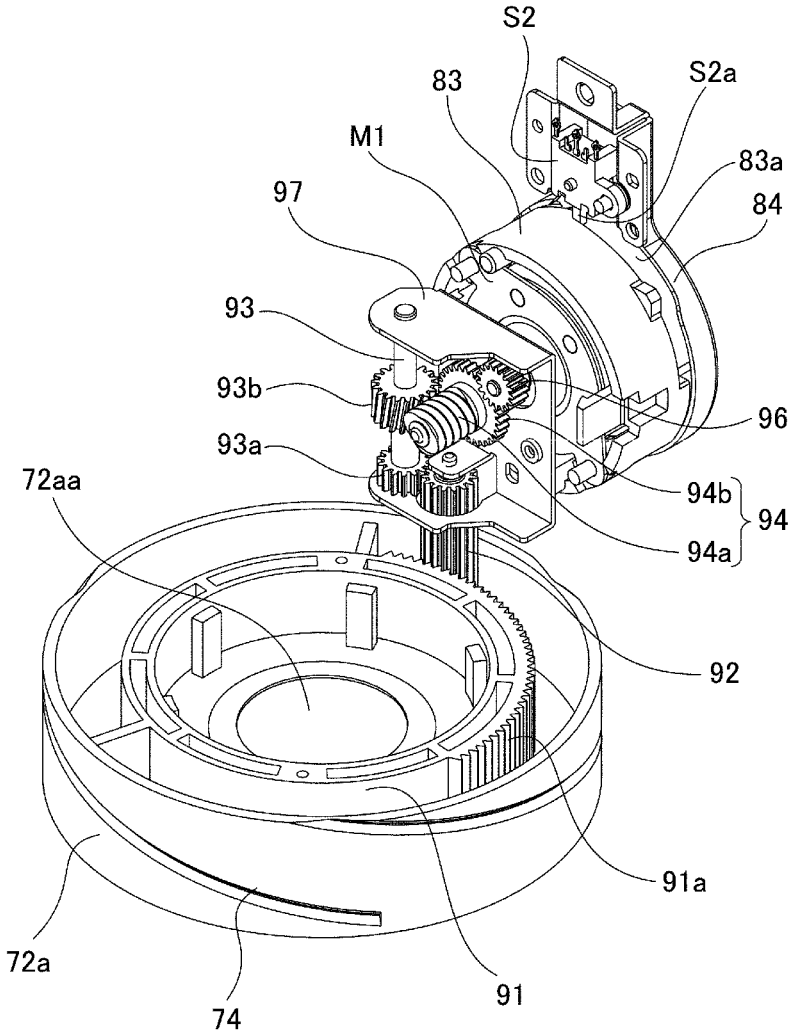
FIG. 7 is a perspective view of a construction for rotating a reflector.

As shown in FIG. 7, the rear surface of the reflector 72*a* (hereinafter also referred to as "back surface") is provided with a circular projecting rib 91*a* exteriorly of the circular opening 72*aa*, and a gear 91*a* meshing with the a gear 92*a* is formed over about ¼ extent of the outer peripheral surface of the projecting rib 91. Furthermore, the gear 92 is connected to a gear 93*a* of a rotation body 93, and a gear 93*b* of the rotation body 93 is connected to a worm gear 94*a* of a worm gear member 94. The worm gear member 94 is provided at one end thereof with a gear 94*b* which is connected to a gear 96 that is mounted on a rotation axis of a rotary motor M1 (i.e., a drive source). Therefore, when the rotary motor M1 is driven, the torque of the motor is transmitted by the gear train so as to rotate the reflector 72*a*.

In FIG. 7, the torque of the worm gear member 94 is transmitted to the gear 93*b* of the rotation body 93, and the torque is then transmitted through the gear 93*a* to the gear 92. This is because gear ratio is controlled by modifying the sizes of the gear 93*a* and the gear 93*b*, and because of the layout of the components and parts. Accordingly, in a case where there is no need of modifying the gear ratio and there is no layout problem, the worm gear member 94 may be directly connected to the gear 92. Since the reflector is usually disposed adjacent to the light source, the rotary motor may be coupled to the member on which the light source is mount to form a driving portion with a simple mechanism. However, LED is highly exothermic, and heat which is transmitted from the LED to the rotary motor will affect the lifetime characteristics due to the evaporation of oil in the bearing of the rotary motor. Therefore, in order to avoid the heat of the LED directly transmitting to the rotary motor, the rotary motor is preferably arranged away from a thermal path.

Next, the elements for rotating the reflector 72*a* including the assembled state of the components are described in detail. FIG. 3 shows the components constituting the rotary motor M1 and the gear train in the exploded perspective view. In FIG. 3, the gear 92 of FIG. 7 is omitted. As shown in FIG. 7, the rotation body 93, the worm gear member 94 and the gear 92 (not shown) are supported by a gear-mounting member 97 which is coupled to the back side of the bottom surface of the cylindrical portion 81*b* of the housing 80 as shown in FIG. 3 (i.e., the inner surface of the housing 80). The rotary motor M1 is received inside the cylindrical portion 81*b* of the housing 80 and secured together with a cover member 83 to the bottom surface of the cylindrical portion 81*b*. The gear 96 (not shown) mounted on the rotation axis of the rotary motor M 1 is led into the housing 80 through the opening 82*b* provided in the bottom surface of the cylindrical portion 81*b* of the housing 80, and connected to the gear 94*b* of the worm gear member 94.

An arm portion-mounting member 84 rotatably supporting the cover member 83 is coupled to the arm portion 60*b* such that a part of the cover member 83 is exteriorly surrounded by the arm portion-mounting member 84. Accordingly, the cylindrical portion 81*b* of the housing 80, including the rotary motor M1 is adapted to rotate with respect to the arm portion 60*b*. Furthermore, the arm portion 60*b* is provided with an arm cover member (not shown in FIG. 3) which is similar to the arm cover member 61*a* shown in FIG. 8, and has the appearance similar to the arm portion 60*b* shown in FIGS. 1 and 2.

As described above, the light distribution angle adjusting means of the spot-lighting apparatus 10 in accordance with the embodiment operates the light distribution angle adjusting mechanism 72 which is configured to control the state of light distribution (i.e., the spot diameter) and is mainly comprised of one reflector 72*a*, the movable body 72*b* provided with the Fresnel lens 76, and the support 72*c* by means of the gear train and the rotary motor M1 (i.e., the driving source) which are disposed at the end of the arm portion 60*b* and are coupled to the housing 80. Therefore, in comparison with the conventional lighting apparatus which uses a plurality of mirror pieces for the reflector, the embodiment does not need a plurality of parts corresponding to the plurality of mirror pieces for operation, thereby reducing the number of parts, as well as, manufacturing cost.

(Vertical Angle Adjusting Means)

Figure 8:
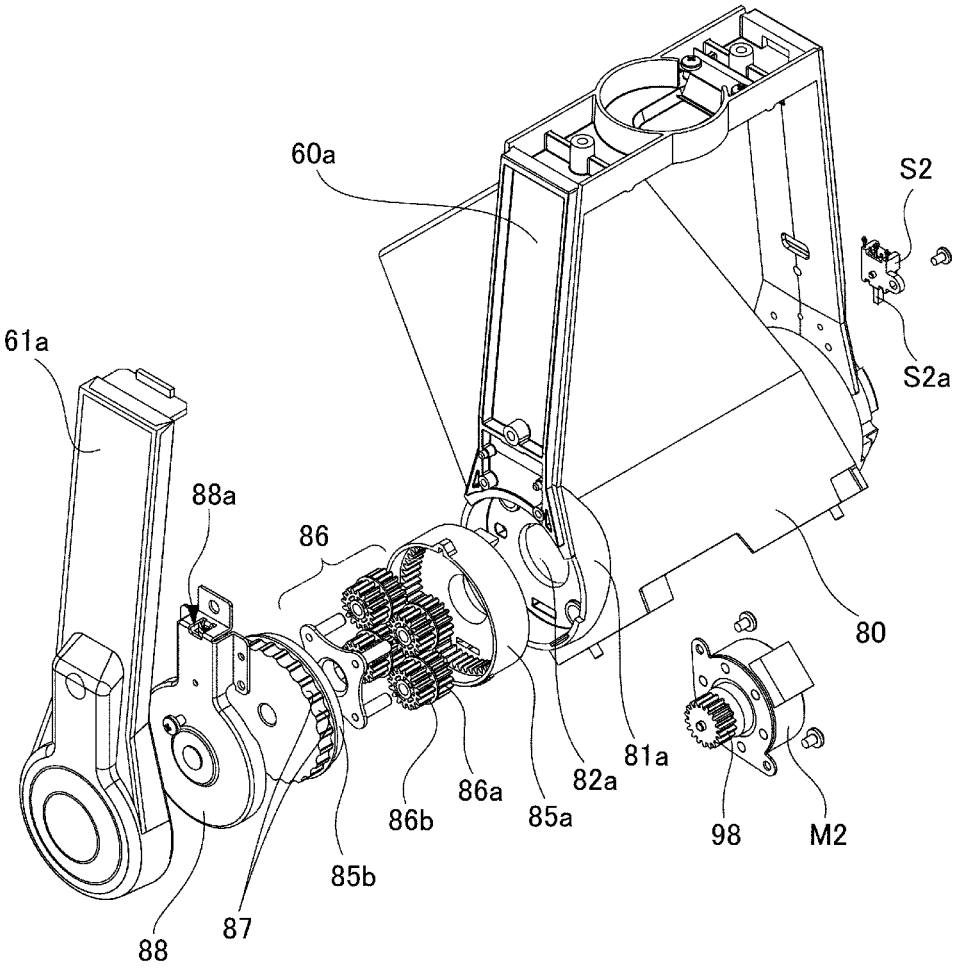
FIG. 8 is an exploded perspective view showing a construction of vertical angle adjusting means.

With reference to FIG. 8, the construction of the vertical angle adjusting means is described. FIG. 8 is an exploded perspective view to assist in understanding the construction of the vertical angle adjusting means. As shown in FIG. 8, the vertical angle adjusting means are mainly comprised of cylindrical halves 85*a*, 85*b*, a rotary motor M2 (i.e., a drive source) and a gear train. The rotary motor M2 is coupled to the back side of the bottom surface of the cylindrical portion 81*a* of the housing 80 (i.e., the inner surface of the housing 80) and a gear 98 mounted on the rotation axis of the rotary motor M2 is led into the cylindrical portion 81*a* through an opening 82*a* provided in the bottom surface of the cylindrical portion 81*a* of the housing 80.

The cylindrical half 85*a* which has a gear formed on the inner peripheral surface thereof is coupled to the cylindrical portion 81*a* of the housing 80. The cylindrical half 85*a* has an opening at the bottom surface thereof, and the gear 98 mounted on the rotation axis of the rotary motor M2 is led into the cylindrical half 85*a* through the opening. The cylindrical half 85*b* receiving an epicycle gear 86 is rotatably mounted relative to the cylindrical half 85*a*.

Figure 9:
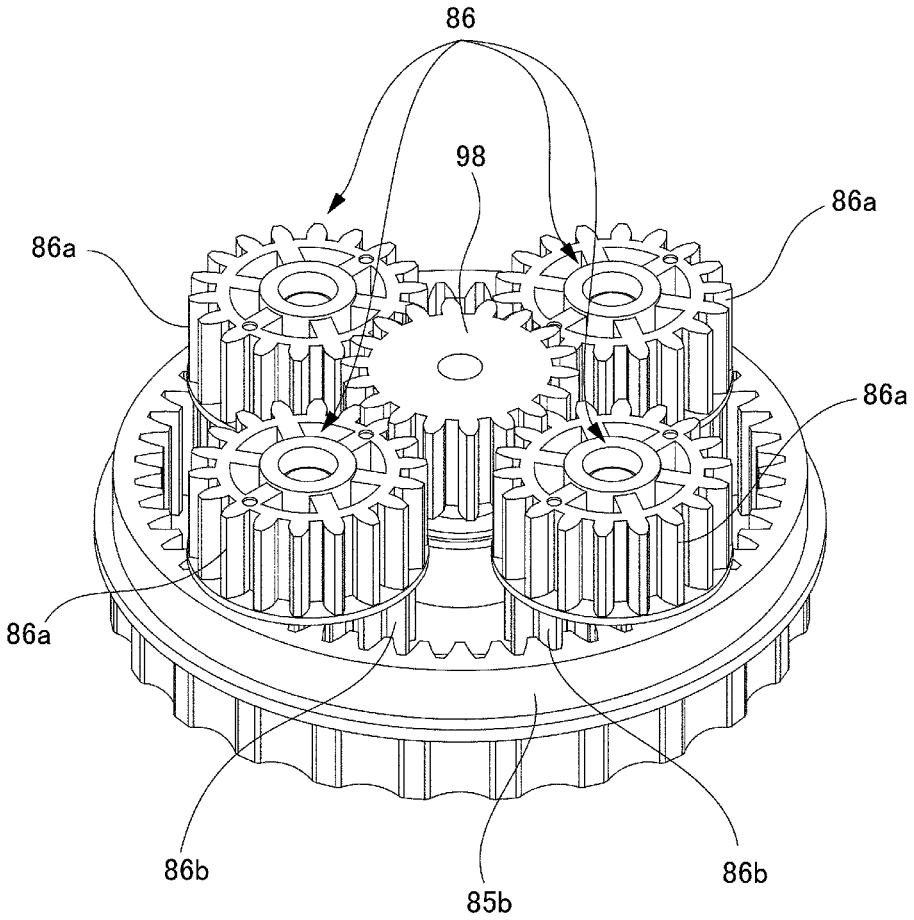
FIG. 9 illustrates a state where an epicycle gear is mounted to a cylindrical half.

FIG. 9 is a perspective view to assist in understanding the interior side of the cylindrical half 85*b* where the epicycle gear 86 is received. As shown in FIG. 9, a gear is also formed in the inner peripheral surface of the cylindrical half 85*b*, and is connected to the epicycle gear 86. The epicycle gear 86 is connected to the gear 98 which is mounted on the rotation axis of the rotary motor M2 and disposed at the central portion of the epicycle gear 86. As such, as the gear 98 rotates, the epicycle gear 86 consisting of four gears rotates.

Returning to FIG. 8 for describing the gear portion of the epicycle gear 86, all of the four gears are disposed within the cylindrical half 85*a*, and the diameter of the gear 86*a* connected to the gear provided in the inner peripheral surface of the cylindrical half 85*a* is greater than that of the gear 86*b* connected to the inner peripheral surface of the cylindrical half 85*b*. Therefore, in this epicycle gear 86 the gear ratio with respect to the cylindrical half 58*a* and the gear ratio with respect to the cylindrical half 85*b* are different from each other. For the above reason, during the rotation of the epicycle gears 86, the rotating state (i.e., rotation speed) is different between the cylindrical half 85*a* and the cylindrical half 85*b*, thereby realizing the rotation of the cylindrical half 85*a* with respect to the cylindrical half 85*b*.

Figure 13:
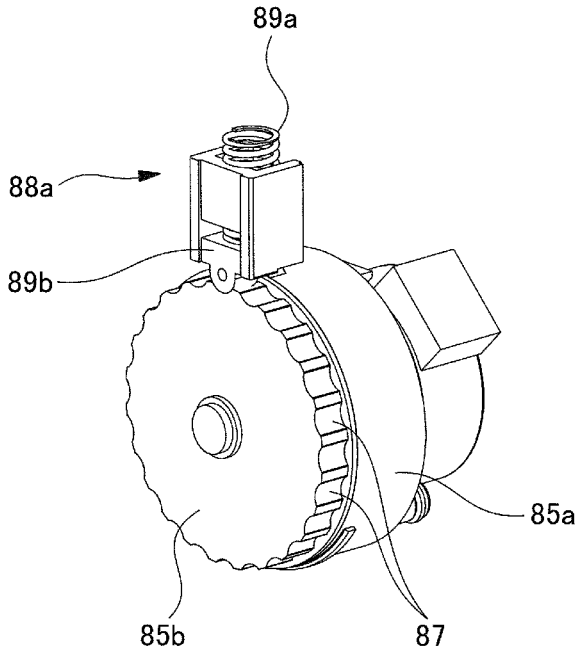
FIG. 13 is a perspective view showing a clutch structure that is incorporated in an arm portion-mounting member.

On the other hand, the outer peripheral surface of the cylindrical half 85*b* is provided with a plurality of depressions 87, and a clutch structure 88*a* is incorporated in the arm portion-mounting member 88 disposed over the cylindrical half 85*b*. Specifically, as shown in FIG. 13, the clutch structure 88*a* has a spring 89*a* and a pressing member 89*b* which is pressed against the depression 87 of the cylindrical half 85*b* due to the force of the spring. The arm portion-mounting member 88 is disposed over the cylindrical half 85*b*, and coupled and fixed to the arm portion 61*a*. Moreover, when the assembly of all the components is completed, the arm cover member 61*a* is mounted to the arm portion 60*a*.

The cylindrical half 85*b* is generally formed as a fixed end which is not rotatable with respect to the arm portion 60*a*. However, if a certain amount of torque exceeding the spring force of the clutch structure 88*a* acts on the cylindrical half 85*b*, the cylindrical half 85*b* is rotated with respect to the arm portion-mounting member 88.

When the rotary motor M2 is rotated, due to the aforementioned difference of the rotating state between the cylindrical half 85*b* and the cylindrical half 85*a*, the housing 80 including the cylindrical half 85*a* is rotated with respect to the cylindrical half 85*b*. The rotation of the housing 80 including the cylindrical half 85*a* with respect to the cylindrical half 85*b* due to the rotation of the rotary motor M2 does not put a load on the clutch structure 88*a*, and the fixed state of the cylindrical half 85*b* with respect to the arm portion 60*a* is not thus changed. Accordingly, due to the rotation of the rotary motor M2, the housing 80 including the cylindrical half 85*a* is rotatable with respect to the arm, thereby allowing for the vertical angle adjustment. As such, due to the arm portion-mounting member 88 the rotary motor M2 and the gear train including the epicycle gear 86 are disposed at the end of the arm portion 60*a*, thereby causing the lighting body 90 including the light source unit 70 to rotate in the vertical direction.

On the other hand, when independently of the rotation due to the rotary motor M2, one puts a load such an excessive force in order to rotate the lighting body 90 including the light source unit 70, in a case of the cylindrical half 85*b* being the fixed end where the cylindrical half 85*b* is not rotated at all with respect to the arm portion 60*a*, the epicycle gear 86 may be damaged by the load. In this regard, in the embodiment, the cylindrical half 85*b* is provided with the plurality of depressions 87 at the outer peripheral surface thereof and the clutch structure 88*a* is provided in the arm portion-mounting member 88, as mentioned previously.

As a result, even if someone attempts to rotate the lighting body 90 including the light source unit 70 with the excessive force, or even if an excessive impact or vibration is put on the lighting body 90 during, for example, transportation, the cylindrical half 85*b* rotates inside the arm portion-mounting member 88 before the epicycle gear 86 is damaged. As such, a damage on the mechanical structure portion such as the gear train can be avoided.

Furthermore, in the embodiment, the operation of about 90° as the vertical angle adjustment can be made. That is, angular adjustment is made from the state where the lighting body 90 including the light source unit 70 is substantially horizontal to the state where the lighting body 90 including the light source unit 70 is oriented right below. In the embodiment, in order not to make the vertical angle adjustment beyond the operation range of about 90°, a mechanism for limiting the range of the vertical angle adjustment to about 90° is provided using a detection switch S2 as shown in FIG. 8.

Specifically, the detection switch S2 as shown in FIG. 8 is secured to the arm portion-mounting member 84, as shown in FIG. 7 and a detection leg S2*a* downward projecting from the detection switch S2 is disposed inside a notched groove 83*a* of the cover member 83 as shown in FIGS. 7 and 3. Furthermore, the notched groove 83*a* of the cover member 83 is formed over an extent of about ¼ of the outer periphery.

In the vertical angle adjustment, when the cover member 83 is rotated with respect to the arm portion-mounting member 84, the end portion of the notched groove 83*a* of the cover member 83 reaches the detection leg S2*a*, and the detection leg S2*a* is then pressed by the end portion of the notched groove 83*a*. As a result, the detection leg S2*a* facing directly below as shown in FIGS. 3 and 7 changes its orientation to the left or right direction, the detection switch S2 detects an end (i.e., a mechanical end) of the vertical angle adjustment range. Furthermore, once the end (i.e., the mechanical end) of the vertical angle adjustment range is detected, the operation of the rotary motor M2 is stopped so as to prevent an over rotation in the vertical angle adjustment.

For example, while an electrical wiring for transmitting electric power and control command from the power supply member 20 to the LED light source and/or the rotary motors M1, M2, and the like is arranged, the over rotation can be prevented. Accordingly, during the vertical angle adjustment, the lighting body 90 including the light source unit 70 is prevented from continuous rotation (i.e., over-rotation), and the electric wiring is thus prevented from twisting and being broken.

Furthermore, the light distribution angle adjusting means are provided with a mechanism for suppressing the over-rotation of the reflector 72*a* with the same configuration as described previously. More specifically, the light source portion 71 of the light source unit 70 of FIG. 1 is provided with a detection switch (not shown) which is configured to detect an end (i.e. a mechanical end) of the reflector 72 in the rotational direction and to stop the operation of the rotary motor M1 once detecting the end (i.e., the mechanical end) of the reflector 72 in the rotational direction. Accordingly, even if the reflector 72*a* is in a state of over-rotation, for example, the breakage of the gear 92 can thus be avoided.

As described above, the vertical angle adjusting means of the spot-lighting apparatus 10 in accordance with the embodiment is mainly comprised of the two cylindrical halves 85*a*, 85*b*, each of which has the gear formed in the inner peripheral surface thereof, the epicycle gear 86 received in the cylindrical halves 85*a*, 85*b*, and the rotary motor M2 having the gear 98 mounted on its rotation axis connected to the epicycle gear 86, in terms of the construction of parts. In comparison to the conventional lighting apparatus, the spot-lighting apparatus in accordance with the embodiment has a further simplified construction and does not need a part such as a geared belt or a tension pulley, thereby saving manufacturing cost.

(Horizontal Angle Adjusting Means)

Figure 10:
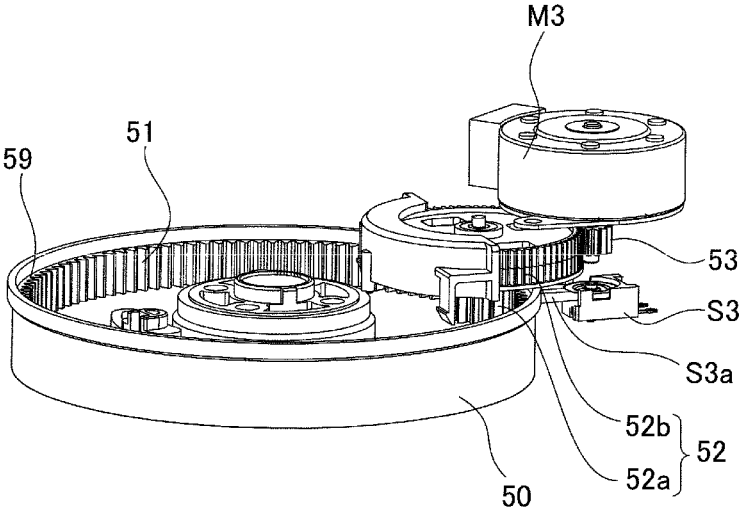
FIG. 10 is a perspective view showing a construction for rotating a horizontal rotary member.
Figure 11:
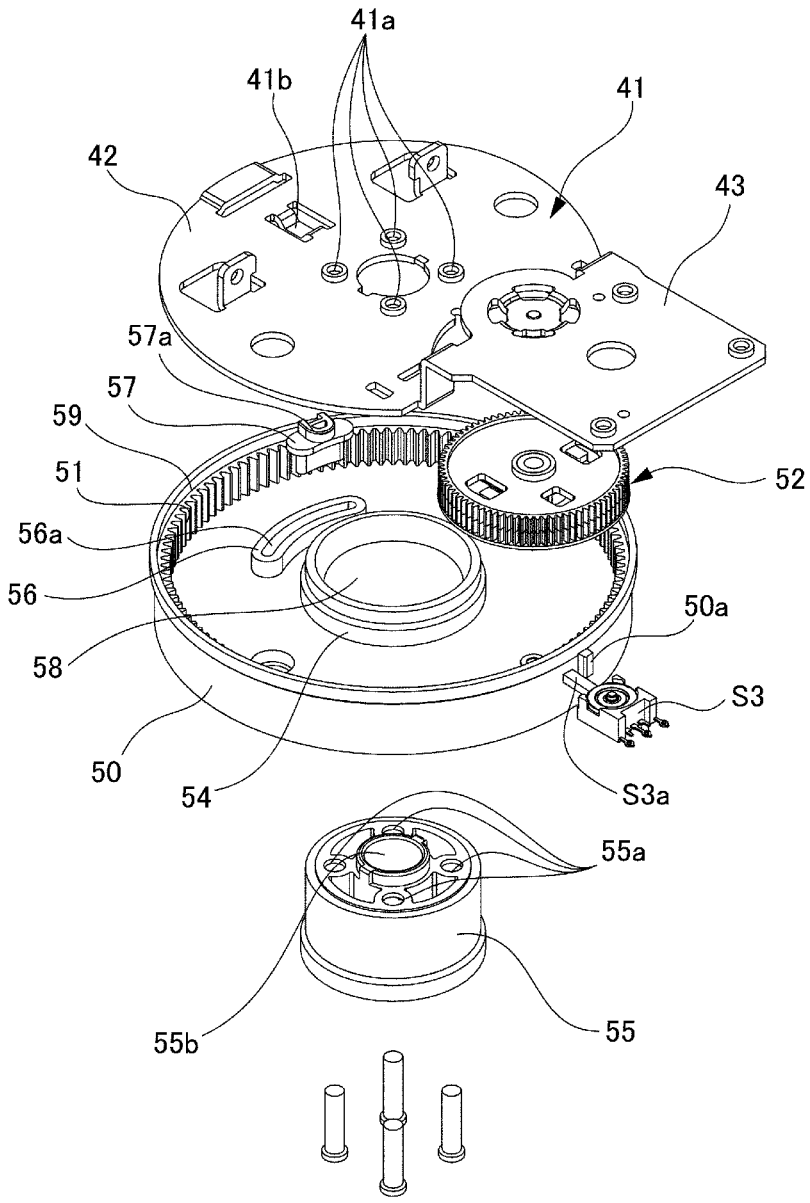
FIG. 11 is a perspective view showing a construction for rotatably supporting a horizontal rotary member.
Figure 12:
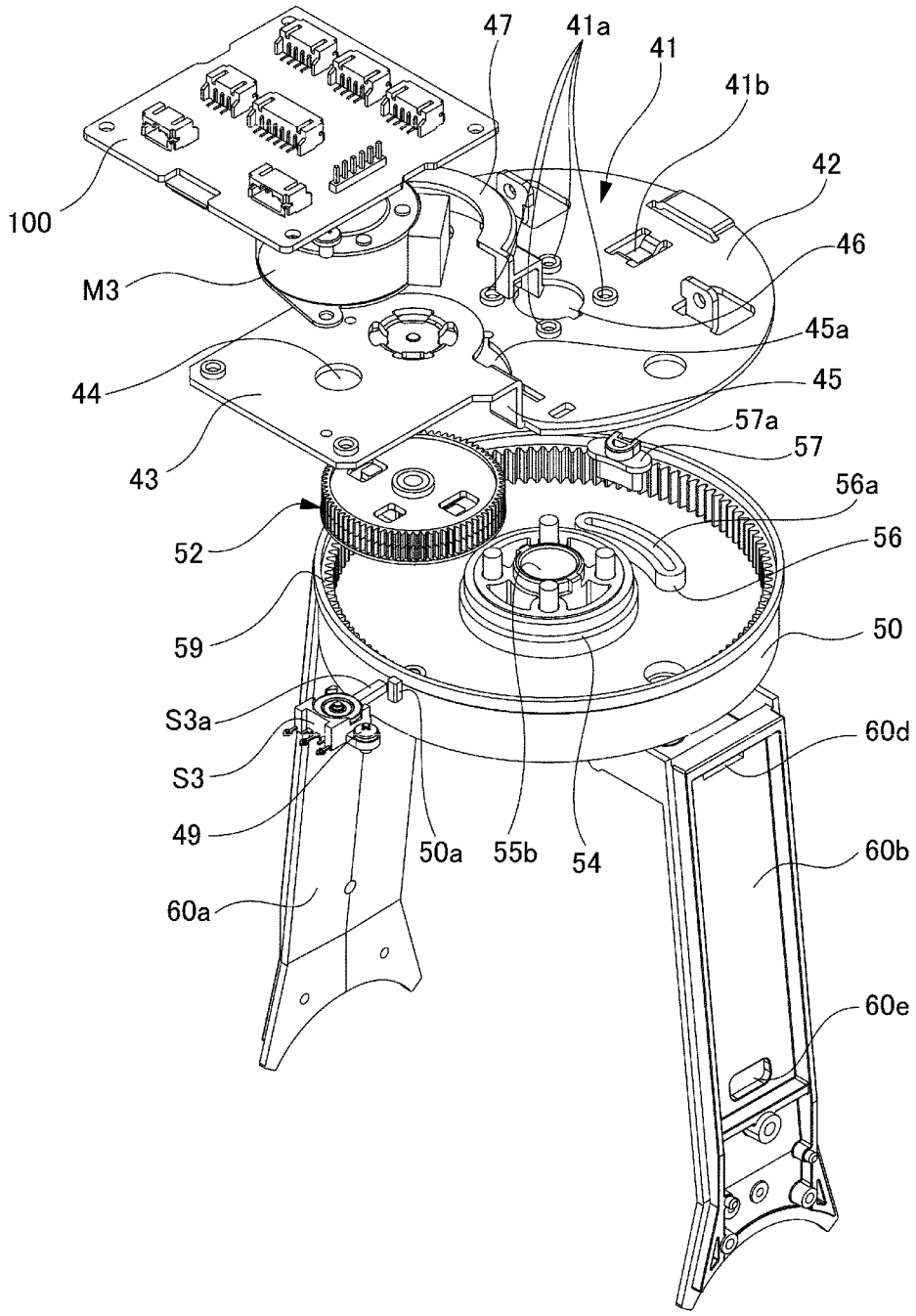
FIG. 12 is an exploded perspective view showing a construction of horizontal angle adjusting means.

With reference to FIGS. 10-12, the construction of the horizontal angle adjusting means is described. The horizontal angle adjustment is briefly described, and the component or parts assembled will be described later.

As shown in FIG. 10, the horizontal rotary member 50 is a cylindrical member, and has a gear 51 formed on an inner peripheral surface thereof. The gear 51 formed on the inner peripheral surface of the horizontal rotary member 50 is connected to a small-diameter gear 52*a* of a gear 52 which has the small-diameter gear 52*a* and a large-diameter gear 52*b*. The large-diameter gear 52*b* of the gear 52 is partly disposed outside the horizontal rotary member 50 such that it steps over an upper peripheral edge of the horizontal rotary member 50, and the portion of the large-diameter gear 52 which is disposed outside the horizontal rotary member 50 is connected to a gear 53 which is mounted on the rotation axis of a rotary motor M3 (i.e., a driving source).

Furthermore, as shown in FIG. 12, the base end side of the U-shaped arm having the pair of arm portions 60*a*, 60*b* is secured to the exterior surface of the bottom surface of the horizontal rotary member 50. Therefore, once the rotary motor M3 is rotated, the torque of the rotary motor M3 is transmitted through the gear train to the horizontal rotary member 50 so as to rotate the horizontal rotary member 50.

Since the base end side of the arm is secured to the horizontal rotary member 50, the member(s) below the arm is together rotated by the rotation of the horizontal rotary member 50. As a result, the lighting body 90 including the light source unit 70 connected to the arm is rotated in the horizontal direction.

Next, description will be given of the construction of the horizontal angle adjusting means in more detail, including the assembled state of the parts. As shown in FIG. 11, the horizontal rotary member 50 has a cylindrical rib 54 which projects upward from the periphery of a central opening 58. A rotation axis 55 is fit into the central opening 58 such that it is rotatable with respect to the horizontal rotary member 50.

Since a flange portion is formed in the lower side of the rotation axis 55 such that it has a diameter greater than that of the opening 58, due to the flange portion the horizontal rotary member 50 is prevented from falling off the rotation axis 55.

On the other hand, a base portion 40 provided with a cover member 48 and a support member 41 (see FIGS. 1 and 2) is disposed over the horizontal rotary member 50. The upper peripheral edge of the horizontal rotary member 50 is interiorly provided with a step 59 for receiving the support member 41. The support member 41 is disposed in the step 59 such that it is rotatable with respect to the horizontal rotary member 50. The central portion of the support member 41 is provided with a screw-securing hole 41*a* which threadably engages and fixes a screw which is inserted from below the rotation axis 55 through four through-hole 55*a* of the rotation axis 55. The rotation axis 55 is secured to the support member 41 by means of the screw, thereby allowing the horizontal rotary member 50 to be rotatably supported with respect to the support member 41.

FIG. 12 is a view where the members such as the rotary motor M3, the arm and a wireless communication unit 100 are added to the FIG. 11. The support member 41 has a slidable lid portion 42 disposed on the horizontal rotary member 50, and a member arrangement portion 43 formed as a step higher than the sliding lid portion 42. The member arrangement portion 43 is coupled to the rotary motor M3 at an upper surface thereof, and the gear 53 (see FIG. 10) which is mounted on the rotation axis of the rotary motor M3 is arranged at the side of the lower surface of the member arrangement portion 43 through an opening 44 formed in the member arrangement portion 43. Furthermore, the gear 52 is rotatably coupled to the side of the lower surface of the member arrangement portion 43 such that it is connected to the gear 53 (see FIG. 10) mounted on the rotation axis of the rotary motor M3.

In order not to interfere with the gear 52, a notch 45*a* is partly formed in a vertical wall portion 45 connecting the slidable lid portion 42 and the member arrangement portion 43. An opening 46 is formed in the middle of four screw-securing holes 41*a* of the support member 41. The electric wiring (not shown) drawn from the power supply member 20 (see FIGS. 1 and 2) is led through the opening 46 and a central through-hole 55*b* of the rotation axis 55 into the lower surface side of the horizontal rotary member 50, and then guided into the arm. In order to prevent the electric wiring from contacting the gear 52, a gear cover 47 is disposed in the location of the notch 45*a* of the vertical wall portion 45 so as to cover the gear 52 which is exposed through the notch 45*a*. Furthermore, the wireless communication unit 100 is disposed over the rotary motor M3 to perform a communication with or between the light distribution angle adjusting means, the horizontal angle adjusting means, and the vertical angle adjusting means, thereby allowing for, for example, a remote control. Therefore, the light distribution angle, the vertical angle and the horizontal angle can be adjusted by transmitting control signals (i.e., signals for controlling the light distribution angle, the vertical angle and the horizontal angle) from a remote controller and the like. The rotational position information of each rotary motor M1, M2, and M3 may be transmitted by the wireless communication unit 100. Furthermore, in the embodiment, the rotary motor driving circuit is also constructed on the same substrate.

On the other hand, an upward projecting guide rib 56 is disposed outside the cylindrical rib 54 of the horizontal rotary member 50 so as to form a guide groove 56*a*. A movable slider 57 is arranged in the guide groove 56*a* such that it can be moved within the guide groove 56*a*. The movable slider 57 has an upward projecting portion 57*a* and the support member 41 has an abutting projection 41*b* which downward extends to the height abutting against the side surface of the upward projecting portion 57*a*.

As such, when the horizontal rotating member 50 rotates clockwise or counter-clockwise to about 360°, the abutting projection 41*b* of the support member 41 abuts against the projecting portion 57*a* of the movable slider 57. In a state where the abutting projection 41*b* abuts against the projecting portion 57*a*, if the horizontal rotary member 50 continues to rotate, the movable slider 57 moves within the guide groove 56*a*. Once the movable slider 57 reaches the end portion of the guide groove 56*a*, it cannot move any more thereby causing the horizontal rotary member 50 not to rotate any more.

For the above reason, the horizontal rotary member 50 is prevented from unrestrained rotation in the same direction beyond about 360°. Therefore, it can be avoided that excessive twist occurs in the electric wiring (not shown) which is led through the opening 46 of the support member 41 and the central through-hole 55*b* of the rotation axis 55 into the lower surface side of the horizontal rotary member 50 and then guided into the arm, which may cause the electric wiring to be broken. As described previously, in the embodiment the horizontal rotary member 50 is rotated in the horizontal direction by means of the rotary motor M3 (i.e., the driving source) and the gear train which are coupled to the member arrangement portion 43 of the support member 41 so as to be mounted in the base portion 40 (see FIGS. 1 and 2).

The rotary motor M3 which is adapted to be stopped when the horizontal rotary member 50 cannot rotate any more due to the above structure may cause abnormal noise. For the reason, even if the afore-mentioned structure for mechanically preventing the over-rotation is provided, it is preferable that the rotary motor M3 is stopped by electric control before the horizontal rotary member 50 cannot rotate any more.

More specifically, as shown in FIG. 12, a detection switch S3 similar to the detection switch described above in connection with the vertical angle adjusting means may be adopted. The horizontal rotary member 50 may be provided at the outer peripheral surface thereof with a detection switch protrusion 50*a* for changing the orientation of a detection leg S3*a* of the detection switch S3.

Accordingly, for example, if the horizontal rotary member 50 attempts to further rotate clockwise from the state as shown in FIG. 12, the detection leg S3*a* is pressed clockwise by the detection switch protrusion 50*a* thereby causing the orientation thereof to be changed. The detection switch S3 can detect the mechanical end of the clockwise rotation. Once the mechanical end is detected, the operation of the rotary motor M3 is stopped.

The horizontal rotary member 50 is rotated to the extent of little over 360° corresponding to the movable range of the movable slider 57 within the guide groove 56*a*, and then stopped. On the other hand, the detection of mechanical end by the detecting switch S3 is performed when the horizontal rotary member 50 is rotated clockwise or counterclockwise to the extent of about 360°. Accordingly, before the rotation of the horizontal rotary member 50 is stopped by the movable slider 57, the operation of the rotary motor M3 is stopped by the electrical stop command associated with the detection of the mechanical end by the detection switch S3.

Even if FIG. 12 does not show the coupling of the detection switch S3, the detection switch S3 is secured relative to the base portion 40 as shown in FIG. 1. Specifically, the bottom surface of the cover member 48 of the base portion 40 as shown in FIG. 1 is provided with a through-hole for passing a screw therethrough. The leading end side of the screw 49 as shown in FIG. 12 is guided through the through-hole and the screw 49 threadably engages the screw-securing hole of the detection switch S3. As such, the detection switch S3 is secured relative to the base portion 40.

In the conventional lighting apparatus, in order to constitute the horizontal angle adjusting means, various parts such as a geared belt and/or a tension pulley for adjusting a tension are used in addition to a motor and a gear, thereby increasing the number of parts used as well as needing a space for arranging the parts. Accordingly, it is difficult to downsize the lighting apparatus. By contrast, in the horizontal angle adjusting means of the spot-lighting apparatus in accordance with the embodiment the torque of the rotary motor M3 is directly transmitted via the gear train to the horizontal rotary member 50 having the gear formed in the inner peripheral surface thereof. Accordingly, various parts such as a geared belt and/or a tension pulley for adjusting a tension are not needed, and such a simplified construction allows for manufacturing cost reduction and downsizing.

The electric wiring (not shown) guided to the arm side through the central through-hole 55*b* of the rotation axis 55 as described above is guided through a notch 60*c* formed in the arm as shown in FIG. 3, and then an opening 60*d* to the arm portion 60*b*. Subsequently, the electric wiring (not shown) is guided through an opening 60*e* formed in the arm portion 60*b* to the housing 80 side. The electric wiring drawn from the location adjacent to the housing 80 is inserted into the housing 80 through a through-hole (not shown) provided in the housing 80, and guided through the housing 80 to the rotary motor M2, the light source and the like.

As described previously, in the spot-lighting apparatus 10 in accordance with the invention, the electric wiring is only arranged inside the arm. Accordingly, the spot-lighting apparatus 10 in accordance with the embodiment does not need to arrange various parts such as a gear, a geared belt and a tension pulley in the arm, compared with the conventional lighting apparatus. As a result, as shown in FIG. 1, the outer diameter of the arm portion can be suppressed, and slimmer arm shape with good looking can be obtained.

While the invention is described with reference to specific embodiments, the invention is not limited to the above embodiments. It will be apparent to one skilled in the art that various modification or improvement can be made to the above embodiments. Furthermore, it will be apparent that the modified or improved versions of the embodiments also fall within the scope of the invention.

For example, in a case where the horizontal angle adjustment (i.e., panning) is unnecessary in the spot-lighting apparatus, the horizontal angle adjusting means may be omitted, and the base portion side of the arm may be directly coupled to the power supply member 20. Conversely, in a case where only the horizontal angle adjustment (i.e., panning) is necessary, the lighting body 90 may be directly coupled to the horizontal rotary member 50.

Furthermore, the afore-mentioned horizontal angle adjusting means and vertical angle adjusting means are effective in not only the spot-lighting apparatus but also any apparatus requiring the horizontal angle adjustment (i.e., panning) and the vertical angle adjustment (i.e., tilting). For example, in the field of surveillance camera and the like often requiring the panning function and tilting function, a surveillance camera instead of the light source unit 70 may be coupled to the housing 80 thereby obtaining the surveillance camera provided with the afore-mentioned horizontal angle adjusting means and vertical angle adjusting mans. As such, the afore-mentioned mechanisms for the horizontal angle adjusting (i.e., panning) mechanism and the vertical angle adjusting (i.e., tilting) mechanism can be generally used in various fields including the lighting apparatus.

REFERENCE SIGNS LIST

10 spot-lighting apparatus
40 base portion
50 horizontal rotary member
52 gear
53 gear
60*a*, 60*b* arm portion
70 light source unit
71 light source portion
72 light distribution angle adjusting mechanism
72*a* reflector
72*b* movable body
72*c* support
74 guide groove (guide portion)
75 engaging projection (engaging portion)
76 Fresnel lens (optical component)
77*c* convex portion (control portion)
78 groove portion
80 housing
86 epicycle gear
90 lighting body
92 gear
93*a*, 93*b* gear
94*a* worm gear
94*b* gear
96 gear
98 gear
100 wireless communication unit
M1, M2, M3 rotary motor (driving source)

The invention claimed is:

1. A lighting apparatus, comprising:
a light source unit comprising:
a light source portion configured to mount a light source thereon, and
a light distribution angle adjusting means coupled to the light source portion and configured to change an irradiation range of the light source, the light distribution angle adjusting means comprising:
a reflector provided with a spiral guide portion in a peripheral surface thereof, configured to being able to be rotated, configured to move a movable element, and configured to reflect a light emitted from the light source,
a movable body comprising an engaging portion configured to slidably engage the guide portion and a control portion configured to limit a direction of a movement of the movable body to a rotation axis direction of the reflector,
a support configured to support a movement of the movable body in the rotation axis direction of the reflector, and
an optical component secured to the movable body and configured to change a light path of the light emitted from the light source.

2. The lighting apparatus according to claim 1, wherein the control portion is a convex portion formed on an outer periphery of the movable body, wherein the support comprises a groove portion which is formed on an inner peripheral surface of the support in the rotation axis direction, and wherein the convex portion slidably engages the groove portion to allow the movable body to be supported by the support.

3. The lighting apparatus according to claim 1, further comprising a horizontal angle adjusting means configured to rotate the light source unit in a horizontal direction, and a vertical angle adjusting means configured to rotate the light source unit in a vertical direction.

4. The lighting apparatus according to claim 3, further comprising a lighting body comprising a housing coupled to the light source unit, an U-shaped arm comprising a pair of arm portions and configured to rotatably support the lighting body, and a base portion configured to support a horizontal rotary member to which the arm is secured such that the horizontal rotary member is rotatable in a horizontal direction, wherein the horizontal angle adjusting means comprises the horizontal rotary member, and a diving source A and gear train A disposed in the base portion and configured to rotate the horizontal rotary member, wherein the vertical angle adjusting means comprises a driving source B and gear train B mounted in the housing to be arranged at an end of one of the pair of arm portions and configured to rotate the lighting body with respect to the arm portion, and wherein the light distribution angle adjusting means comprises a driving source C and gear train mounted in the housing to be arranged at an end of another of the pair of arm portions and configured to rotate the reflector.

5. The lighting apparatus according to claim 4, wherein the gear train B comprises an epicycle gear.

6. The lighting apparatus according to claim 3, further comprising a wireless communication unit configured to perform a communication with any of the light distribution angle adjusting means, the horizontal angle adjusting means and the vertical angle adjusting means.

7. The lighting apparatus according to claim 1, wherein the reflector is configured to receive a rotational force to rotate, and the engaging portion of the movable body slides along the guide portion of the reflector in response to the rotation of the reflector, thereby the movable body moves in a rotational axis direction of the reflector.

8. The lighting apparatus according to claim 1, wherein the support comprises at least one fixture to operatively secure the support to the light source.

* * * * *